US007063034B2

(12) United States Patent
Penny

(10) Patent No.: US 7,063,034 B2
(45) Date of Patent: Jun. 20, 2006

(54) SPRAY SKIRT FOR WATERCRAFT

(75) Inventor: James R. Penny, Eureka, CA (US)

(73) Assignee: Watermark Paddlesports, Inc., Easley, SC (US)

( * ) Notice: Subject to any disclaimer, the term of this patent is extended or adjusted under 35 U.S.C. 154(b) by 0 days.

(21) Appl. No.: 10/916,211

(22) Filed: Aug. 10, 2004

(65) Prior Publication Data

US 2006/0032424 A1 Feb. 16, 2006

(51) Int. Cl.
*B63B 35/00* (2006.01)

(52) U.S. Cl. ..... 114/347

(58) Field of Classification Search ..... 114/347, 114/361

See application file for complete search history.

(56) References Cited

U.S. PATENT DOCUMENTS 1,284,968 A 11/1918 Anderson
4,031,580 A 6/1977 Neumann et al.
4,498,879 A * 2/1985 Burr ..... 441/80
4,520,747 A 6/1985 Masters
4,583,480 A 4/1986 Hamilton et al.
4,699,076 A 10/1987 Curtis et al.
5,076,194 A 12/1991 Curtis et al.
5,331,915 A 7/1994 Snyder
5,367,975 A 11/1994 Hamilton et al.
5,429,065 A 7/1995 McShan
5,511,507 A 4/1996 Allen
5,540,176 A 7/1996 Galea
5,579,715 A 12/1996 Harrell
5,894,811 A 4/1999 Nordby
5,988,098 A * 11/1999 Hillhouse ..... 114/347
6,079,051 A 6/2000 Whinston et al.
6,223,678 B1 * 5/2001 Haller et al. ..... 114/347
6,343,562 B1 2/2002 Ingram

FOREIGN PATENT DOCUMENTS

WO WO 2004/000637 12/2003

* cited by examiner

*Primary Examiner*—Stephen Avila
(74) *Attorney, Agent, or Firm*—Kolisch Hartwell, PC

(57) ABSTRACT

A skirt for a personal watercraft is disclosed, wherein the skirt includes a body having an edge portion configured to be removably attached to the watercraft, and a release extending from an outer portion of the skirt and extending toward and terminating at an inner portion of the skirt. Ventilation systems for a skirt for a watercraft are also disclosed.

6 Claims, 3 Drawing Sheets

SPRAY SKIRT FOR WATERCRAFT

BACKGROUND

Watercraft, such as kayaks, canoes, etc., may have variable shapes, designs and styles for different types of uses. For example, some watercraft may be designed for whitewater use, while others may be designed for recreational use, ocean touring, multi-use, etc.

Many types of watercraft include a cockpit configured to accommodate attachment of a spray skirt. A spray skirt is a skirt that is worn around the waist or torso and that includes a perimeter configured to be attached to a cockpit rim to help prevent water from waves, paddle drips, etc. from entering the cockpit, and to help prevent a watercraft from swamping during an Eskimo roll. Spray skirts typically include an opening that allows the spray skirt to be fitted around a user's waist, and an elastic member such as a bungee cord, rubber gasket, etc. that holds the skirt around the cockpit rim.

Spray skirts also typically include a release mechanism that allows the skirt to be easily removed from around the cockpit. The release mechanism often takes the form of a loop of webbing, cord, etc. attached to the front edge of the spray skirt where the spray skirt attaches to the cockpit rim. For watercraft such as whitewater kayaks and decked canoes, cockpits are sized such that a user may be able to easily reach out to the end of the spray skirt, grab the release mechanism, and pull the release mechanism, causing release of the spray skirt from the watercraft. Whitewater watercraft cockpits are typically small enough that the release mechanism is reachable even when a user is disoriented or trapped against the back deck of the watercraft.

In other watercraft, however, the size and/or shape of the cockpit may make accessing a release mechanism on the front of the spray skirt more difficult. For example, recreational kayaks often have cockpit openings of a substantially larger size than whitewater kayaks. This may provide users with a greater sense of safety, and/or may provide for a greater relative ease of entry and exit. However, due to the large size of these cockpits, it may be difficult for a user to reach a release mechanism disposed at the front of the spray skirt. Moreover, in the event of a capsize, where a user may become disoriented, a release loop disposed a significant distance from the user may be difficult to locate and activate. For these and other reasons, spray skirts are sometimes not used with recreational kayaks.

Likewise, spray skirts may cause a cockpit to be uncomfortably warm, and/or may make the interior of a watercraft to be difficult to access when the spray skirt is in use. A user desiring to ventilate the cockpit or to access the interior of the cockpit must generally remove the spray skirt from around the cockpit to permit ventilation or access.

SUMMARY

Some embodiments provide a skirt for a personal watercraft, wherein the skirt includes a body having an edge portion configured to be removably attached to the watercraft. The skirt further includes a release extending from an outer portion of the skirt and extending toward and terminating at an inner portion of the skirt.

Other embodiments provide a skirt for a personal watercraft, the skirt having an inner portion and an outer portion. The skirt also may include a release configured to release the skirt from the cockpit, wherein the release includes a strap having a first end coupled to the outer portion of the skirt and a second end extending towards the inner portion of the skirt. The release may further include a positioner configured to position the second end in a restricted area accessible to a user.

Yet other embodiments provide a watercraft including a cockpit configured to be occupied by a user, and a skirt. The skirt may include an edge portion configured to be removably attached to the watercraft and a release extending from an outer portion of the skirt and extending toward and terminating at an inner portion of the skirt. The skirt further may have a ventilation system to provide ventilation to the user seated in the cockpit.

In yet other embodiments, a skirt for a watercraft having a cockpit may be provided with the skirt having an edge portion configured to removably attach the skirt to the cockpit, a deck portion configured to extend over the cockpit, and a torso enclosure with a ventilation system to enable a user to selectively ventilate the cockpit.

In yet other embodiments, a skirt for a watercraft is provided. The skirt including an attachment means for removably attaching the skirt to the watercraft and a release means for selectively releasing the skirt from the watercraft.

DETAILED DESCRIPTION OF THE DEPICTED EMBODIMENTS

Figure 1:
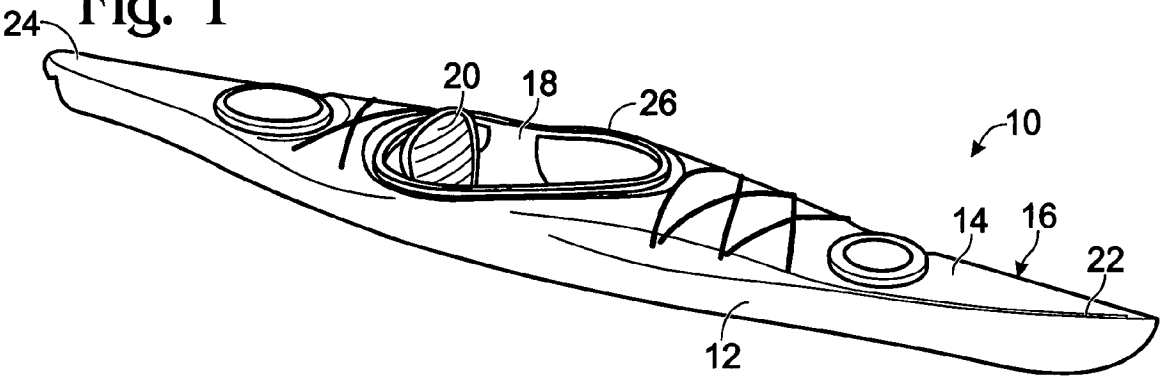
FIG. 1 is a view of an exemplary embodiment of a self-propelled recreational watercraft.

FIG. 1 shows, generally at 10, a first embodiment of a self-propelled watercraft according to the present invention, in the form of a recreational kayak. Watercraft 10 includes a hull 12 and a deck 14. Deck 14 substantially covers hull 12 to form an enclosed body 16. Although described in regards to a recreational kayak, it should be appreciated that the skirt described herein may be used in other suitable watercraft, including touring and whitewater kayaks, open and decked canoes, as well as multi-person watercraft.

Integrated into deck 14 is an opening or cockpit 18 configured to accommodate a user. A seat 20 may be disposed within the cockpit to receive a user, such as a paddler. Depending on the watercraft, also disposed in cockpit 18 may be a back support, hip pads (not shown), hip braces (not shown), foot braces (not shown), thigh braces (not shown), bulkheads (not shown), etc.

It should be understood that watercraft 10 has a bow region 22 and a stern region 24. A user seated on seat 20 faces bow region 22 with legs extending under deck 14 toward bow region 22. Cockpit 18 is positioned between the bow region 22 and stern region 24.

In recreational kayaks, cockpit 18 may be substantially large to accommodate easy entry and exit. Further, the large cockpit may be more comfortable for users over the smaller cockpits found in whitewater kayaks and the like. For example, in some recreational kayaks, the cockpit may be 38"×21", although cockpits with larger or smaller dimensions may be used and are within the scope of the disclosure.

Further the ratio of the dimensions are provided for example only, and it should be appreciated that the cockpit may be of any suitable size and/or shape to accommodate one or more users.

Extending around the perimeter of cockpit 18 is coaming or lip 26. Coaming 26 typically is a raised rim that extends around the border of cockpit 18 and may function to prevent water from splashing into cockpit 18. Although shown as a raised rim, other suitable configurations may be possible for coaming 26.

Figure 2:
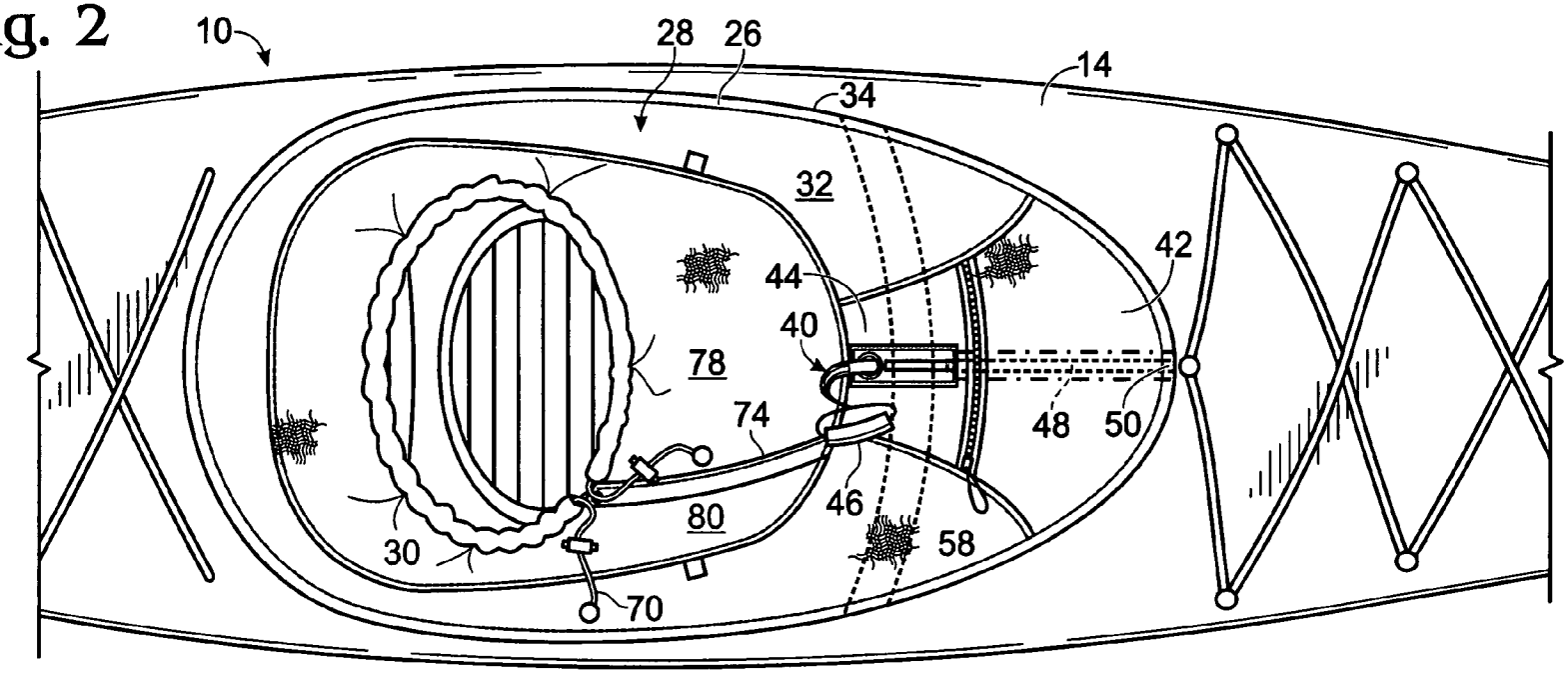
FIG. 2 is a top view of the cockpit region of the watercraft of FIG. 1, showing an embodiment of a spray skirt attached to a cockpit of the watercraft.
Figure 3:
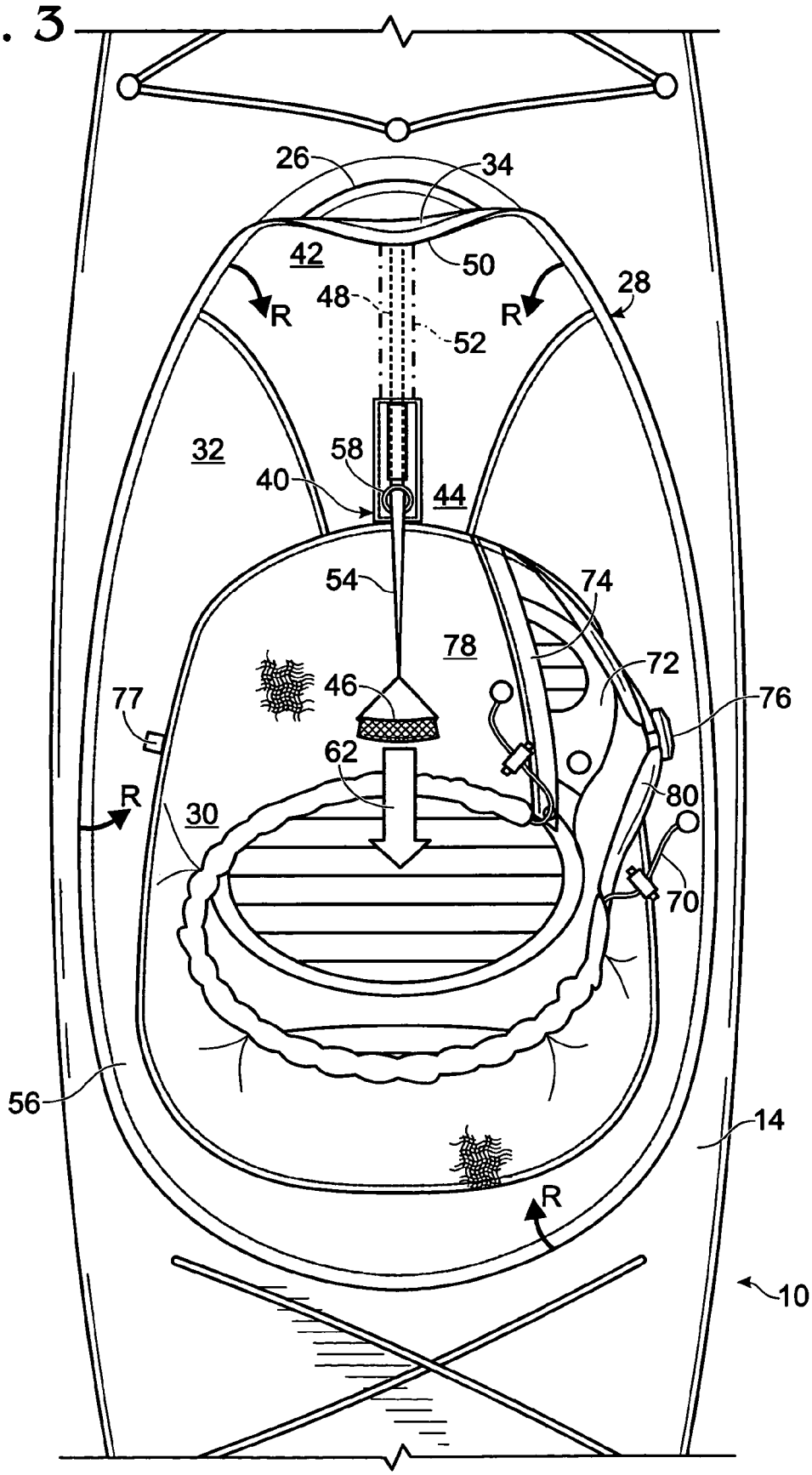
FIG. 3 is a top view of the cockpit region showing the release of the embodiment of FIG. 2 from the cockpit of the watercraft and a ventilation system for the spray skirt.
Figure 4:
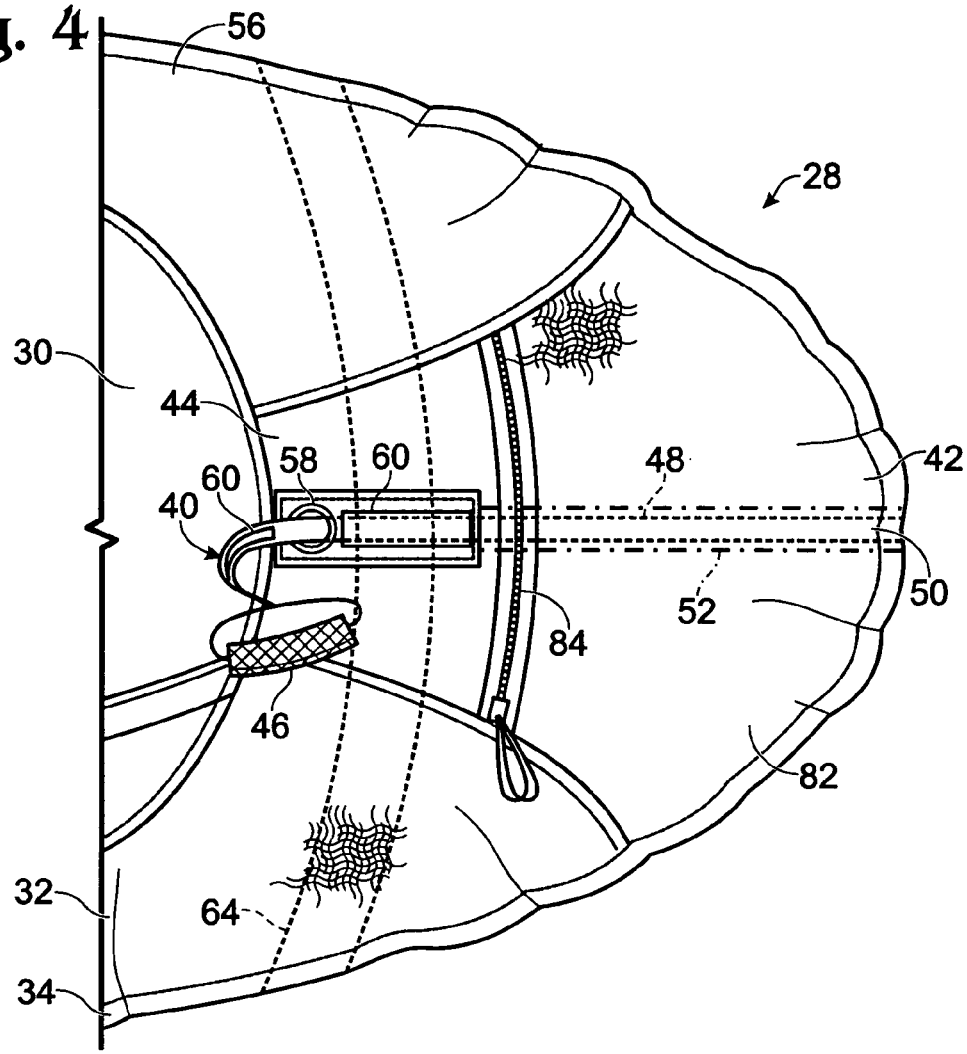
FIG. 4 is a top view of the embodiment of FIG. 2.
Figure 5:
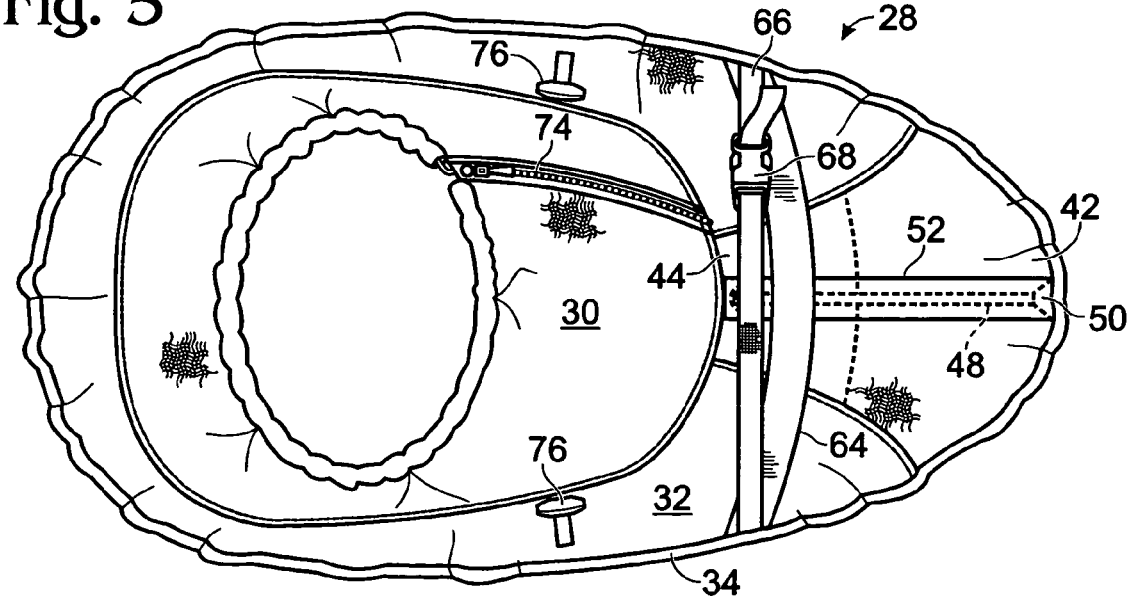
FIG. 5 is a bottom view of the embodiment of FIG. 2.

A spray skirt 28 (or "skirt"), shown in FIG. 2, may be configured to be removably coupled to cockpit coaming 26. Skirt 28 is illustrated in various levels of detail in FIGS. 2–5. FIGS. 2 and 3 illustrate skirt 28 coupled to a watercraft. FIG. 4 is a top view of an exemplary skirt, while FIG. 5 is a bottom view of the skirt. Like reference indicators indicate similar elements throughout the figures.

Referring initially to FIG. 2, skirt 28 includes a torso enclosure 30, a deck portion 32 and an edge portion 34. Torso enclosure 30 includes an opening which may be configured to be fitted around a user's body, such as a user's waist, abdomen, and/or chest. Torso enclosure may extend upwards from deck portion 32 and may be adjusted to the size of the user's body. For example, in some embodiments, torso enclosure 30 may include fitting features that enable a user to fit the torso enclosure snugly around their body. For example, the fitting features may include adjustable cords (such as those indicated at 70), belts, draw cords, suspenders, waistbands, tight-fitting elastic, neoprene, form-fitting materials, etc. By tightly adjusting the torso enclosure to a user's body, water may be prevented from running into the cockpit along the user's body. Torso enclosure 30 may be any suitable material, including light nylon, or other substantially water-repellant fabrics or materials.

Torso enclosure 30 may be coupled to deck portion 32. Deck portion 32 may extend outward from torso enclosure 30 over cockpit 18, such that cockpit 18 is substantially sealed. Thus, deck portion 32 may be understood to form a deck over cockpit 18. Deck portion 32 may correspond to the shape and size of cockpit 18. In this manner, the skirt may be configured for a specific type of cockpit, e.g. a specific shape of cockpit and/or a size of cockpit.

Skirt 28 further includes an edge portion 34. Edge portion 34 extends about the perimeter of skirt 28 and is adapted to be attached to the watercraft such that the skirt is held taut over the cockpit. For example, in some embodiments, edge portion 34 may include a cord, such as a shockcord, or an elastic band or gasket, which is adapted to fit over coaming 26 of the cockpit, stretching the skirt such that it is removably coupled to the watercraft. Thus, a user may easily attach skirt 28 to the watercraft by running edge portion 34 underneath the coaming of the cockpit. When attached, edge portion 34 extends around the outside perimeter of the coaming. The tension of the cord or band over the coaming draws the skirt across the cockpit, sealing the cockpit and enabling the skirt to operate to shed water. The cord and/or band may be specific to particular boat models.

In some embodiments, a release 40 may be operatively coupled to skirt 28. Release 40 may be adapted to enable a user to selectively release the skirt from the watercraft. For example, release 40 may be configured to enable a user to pull edge portion 34 out from under coaming 26. Once a portion of edge portion 34 is disengaged from coaming 26, the entire skirt may be easily pulled away from the watercraft. Release of skirt 28 from the watercraft is further illustrated and discussed with reference to FIG. 3.

Referring to both FIGS. 2 and 3, release 40 may extend from the fore section 42 to a more aft section 44 of deck portion 32 such that handle 46 of release 40 is disposed in close proximity to a user seated within the watercraft. Thus, the handle of the release is disposed in a central inner portion of the skirt, in contrast to a pull which is disposed on the outside periphery of a skirt.

Handle 46 may be any suitable portion of release 40 which may be selectively gripped by a user to effect release of skirt 28 from the watercraft. For example, in the illustrated embodiments, handle 46 is shown as a tubular handle, however other suitable handles are contemplated and are within the scope of the disclosure. For example, handle 46 may be a loop, a ring, a knot, a ball, etc. Further such handles may be composed of any suitable material, including plastic, rubber, nylon, etc.

In some embodiments, handle 46, or a portion of handle 46, may include markings to enable a user to more easily find the handle. For example, handle 46 may colored, for example, such as with a bright color such as orange, which may be easily spotted in a capsize situation. Further, the handle may be sized to enable ease of identification during such situations. For example, a large plastic, colored handle may be easy for a user to identify when underwater. Although a large, bright colored handle is described for illustrative purposes, it should be appreciated that the handle may be of any suitable color, size or design without departing from the scope of the disclosure.

The exemplary release 40, as illustrated in the figures, may include a strap 48 having a first end 50 coupled to fore section 42 of deck portion 32. Fore section 42 may be substantially adjacent to edge portion 34. In some embodiments, first end 50 of strap 48 may be coupled directly to edge portion 34.

Strap 48 may be coupled to fore section 42 or similar region and extend toward a user. Strap 48 may be any suitable material, including, but not limited to, a cord, a band, a plurality of cords or bands, a strip of webbing, etc. Thus, although illustrated as a single strap coupled to a single location on the fore section of the deck portion of the skirt, it should be appreciated that the strap may be coupled to a plurality of positions substantially adjacent the edge portion to affect release of the skirt from the watercraft when pulled. For example, one or more straps may be positioned along the sides of the skirt with such straps extending to the inner portion of the skirt. Linked to such straps may be a handle disposed in the inner portion of the skirt.

As described above, in the illustrated embodiment, strap 48 extends from fore section 42 rearwards towards aft section 44 of deck portion 32. In some embodiments, a pocket 52 (indicated in FIGS. 3, 4 and 5) may be provided on the underside of deck portion 32. Pocket 52 may be configured to maintain strap 48 substantially adjacent to skirt 28, preventing strap 48 from dangling into the cockpit. Thus, pocket 52 may prevent accidental tripping of release 40 by ensuring that strap 48 does not get caught on a user or on a user's gear.

Second end 54 of strap 48 may extend outwards through pocket 52 through the topside 56 of deck potion 32 to handle 46. Handle 46 may thus be accessible from the topside of the skirt. It should be appreciated that in the illustrated embodiments, strap 48 extends from the underside and fore portion of the skirt to the topside and more aft portion of the skirt. However, in other embodiments, the strap may extend along the topside or in another suitable pocket of the skirt.

As described above, second end 54 may be tied or otherwise attached to handle 46. In other embodiments, second end 54 may function as handle 46 or be a portion of handle 46.

A positioner may be provided to position second end in restricted area on deck portion 32 accessible to a user, such as a region substantially adjacent a user. Any suitable positioner may be used, including, but not limited to, grommets, rings, such as d-rings or o-rings, loops such as plastic, fabric or metal loops, etc. Such a positioner helps to hold second end 54 in a specific, restricted area so that a user knows where to reach to find second end 54, even in a high-stress situation.

In the illustrated embodiment, second end 54 extends through a positioner in the form of a grommet or ring 58 in the deck portion of the skirt. Grommet 58 may maintain the strap in a select exit position from pocket 52. The exit position may be easily accessible to a user positioned within the torso enclosure of the skirt. Specifically, the exit position of the strap may be near the torso of a user sitting within the cockpit of the kayak. Thus, the handle, extending from the second end 54 of strap 48 may be easily accessible to a user seated in the cockpit of the kayak. Thus, the grommet may define an exit position for strap 48 in the inner region of the skirt.

In some embodiments, release 40 may include a fastening device or keeper 60 (shown best in FIG. 4) configured to enable a user to removably engage the second end 54 (and the handle) against the topside of the skirt. When engaged or maintained by the keeper, the handle may be considered to be in a storage position. Furthermore, keeper 60 may help keep second end 54 in an easily located position. In the illustrated embodiment, hook and loop fasteners, e.g. VELCRO, may be attached to the second end and the top side of the aft region of the deck portion. A user may lock the second end by engaging the second end with the corresponding tape on the skirt. Although the use of hook and loop fasteners are described, other methods (including, but not limited to, tie-downs, buckles, etc.) may be used to releasably position the second end of the strap to the skirt during use of the watercraft.

In use, handle 46 may be pulled (as indicated by arrow 62 in FIG. 3) by a user, thus pulling strap 48 in a direction away from the attachment point of first end 50 of strap 48. As the strap is pulled, pressure is applied to the edge portion adjacent the attachment point of first end 50. For example, in the illustrated embodiment, first end 50 is disposed on the fore section 42 of the deck portion of the skirt. Pulling on strap 46 in a rearward direction (toward the stem of the boat) causes edge portion 34 to pull up and over coaming 26 of the cockpit, releasing the front portion of the skirt 28 from the watercraft. As the front edge portion pulls away from the coaming, the rest of the edge portion releases from the coaming, effecting total release of the skirt from the watercraft. Arrows R in FIG. 3 indicate the release of the edge portion 34 from coaming 26.

Such release capabilities may be necessary during a capsize. As the watercraft rolls over, a user may become disoriented. By positioning handle 46 in close proximity to the user's body, the user may quickly and easily find and grasp handle 46 of release 40. The user simply applies pressure to the handle, thus pulling strap 48 and effecting release of edge portion 34 from coaming 26. The release of a portion of the skirt from the watercraft enables release of the entire skirt from the watercraft. Upon release, the user may be free to exit the cockpit substantially unhindered by the skirt.

FIG. 5 provides a bottom view of skirt 28. As described above, skirt 28 may include a release with a strap 48 (indicated in phantom) that extends through a pocket 52. Pocket 52 may be sewn on the underside of the skirt and extend from fore section of deck portion 42 towards an aft section of deck portion 44.

Further illustrated on the underside of skirt 28 is brace or stay 64. Brace 64 may extend perpendicular to the long axis of the skirt along the underside of deck portion 32. Brace 64 may help maintain the skirt in an arched configuration such that room is provided for a user's knees and water is easily shed from the skirt. An adjustment strap 66 with an adjustment device 68, such as a buckle or other fastener, may be provided to enable a user to selectively size the arch formed by brace 64. Further, a user may selectively tighten or loosen brace 64 to adjust the skirt to better fit the skirt to different-sized cockpits.

FIGS. 2, 3 and 5 further illustrate a method for selectively ventilating or opening cockpit 18 when skirt 28 is attached to the watercraft. Specifically, torso enclosure 30 typically includes fitting features (described above), which are configured to tighten the torso enclosure such that it fits snugly around a user's body. Fitting features, such as draw strings 70, may extend around the perimeter of the torso enclosure, such that a user may tighten the torso enclosure around their body.

As shown, in some embodiments, skirt 28 may include a ventilation system to provide ventilation to a user seated in a cockpit of the watercraft. For example, a slit or opening 72 may be provided in torso enclosure 30. Slit 72 may be configured to be selectively opened and closed, such as through the use of a fastening device, such as a zipper 74 and/or hook and loop fasteners. In some embodiments, VELCRO may be provided as a second fastening device in combination to zipper 74. By closing slit 72, the torso enclosure may circumscribe a user's body. Additionally, in some embodiments, draw strings 70 may be provided, which when drawn together, may operate to tighten the torso enclosure around a user's body.

Slit 72 may enable a user to access/exit the torso enclosure with relative ease. For example, a user may unzip zipper 74, such that the torso enclosure is interrupted and does not fully encircle a user's body. Such opening of the torso enclosure may further operate to ventilate the cockpit.

In some embodiments, opening slit 72 defines two flaps 78, 80. The flaps may be positioned in a ventilation position using a fastening device. For example, one or more tie downs 76 (shown in FIGS. 3 and 5) may be provided to secure flaps 78, 80 of an open torso enclosure. In the illustrated embodiment, exemplary tie downs 76 are provided on the underside of the skirt. A user may roll one or both flaps 78, 80 and secure the rolled fabric in a ventilation or open position as shown on the left side of the cockpit in FIG. 3.

Any suitable tie down may be used without departing from the scope of the disclosure. For example, tie down 76 may be any suitable fastening device, including, but not limited to a plastic clip, a button, a tie-down loop or strap, or any other suitable fastening mechanism. In FIGS. 3 and 5, a bullet clip is illustrated with which a section of webbing 77 extending from the flap may be looped or mated.

Referring to FIG. 3, flap 80 is shown rolled and secured using tie down 76. By securing flap 80 with tie down 76, the loose fabric is disposed out of a user's way for ease of paddling or entry/exit of the watercraft. Further such a tie-down provides select venting of the cockpit. For example, a user may selectively opt to secure a single flap using the tie down assembly, or alternatively, the user may select to secure both flaps 78, 80 with the tie down assembly. It should be appreciated that although a single opening is provided in skirt 28, in some embodiments, two, three, four or more openings may be provided in the torso enclosure. Such openings may generate a plurality of flaps, each of which may be provided with tie-downs as described above.

Skirt 28 may further include additional features, including accessory pockets. For example, as shown in FIG. 4, an accessory pocket 82 may be provided within deck portion 32. A zipper 84 may be used to close accessory pocket 82. Such accessories pockets may enable a user to store select accessories in close proximity to the user during use of the watercraft.

Although the present disclosure includes specific embodiments of watercraft, outfitting for watercraft, and accessories for watercraft, specific embodiments are not to be considered in a limiting sense, because numerous variations of watercraft and outfitting, and accessories are possible. The subject matter of the present disclosure includes all novel and nonobvious combinations and subcombinations of the various methods, watercraft, outfitting, and other elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A skirt for a personal watercraft, the skirt comprising:

a body having an edge portion configured to be removably attached to the watercraft; and a release extending from an outer portion of the skirt and toward and terminating at an inner portion of the skirt, wherein the release includes a strap coupled at a first end substantially adjacent the edge portion, and wherein the skirt further includes a deck portion, and the strap extends through a pocket coupled to the deck portion.

2. The skirt of claim 1, wherein the skirt has a topside and the strap exits the underside to the topside through an outlet in the deck portion.

3. The skirt of claim 2, wherein the outlet is proximal to a torso enclosure of the skirt.

4. The skirt of claim 1 wherein the pocket is coupled to the underside of the deck portion.

5. A skirt for a personal watercraft with a cockpit, the skirt comprising:

an inner portion;

an outer portion; and a release configured to release the skirt from the cockpit, wherein the release includes a strap having a first end coupled to the outer portion of the skirt, the strap being configured to extend through a pocket in the skirt; a second end extending towards the inner portion of the skirt; and a positioner configured to position the second end in a restricted area accessible to a user.

6. The skirt of claim 5 wherein the pocket is in the underside of the skirt.

* * * * *